United States Patent [19]

Sasaki et al.

[11] Patent Number: 5,021,214

[45] Date of Patent: Jun. 4, 1991

[54] AG ALLOY OF HIGH DISCOLOURATION RESISTANCE

[75] Inventors: Hiroshi Sasaki; Makoto Nishiya, both of Hakodate, Japan

[73] Assignee: Kabushiki Kaisha Zero One, Hakodate, Japan

[21] Appl. No.: 454,312

[22] Filed: Dec. 26, 1989

[30] Foreign Application Priority Data

Jan. 11, 1989 [JP] Japan ..... 1-4448

[51] Int. Cl.[5] ..... C22C 5/06; C22C 5/08

[52] U.S. Cl. ..... 420/504; 420/501; 420/502; 420/506

[58] Field of Search ..... 420/501, 502, 504, 506

[56] References Cited

U.S. PATENT DOCUMENTS 3,811,876 5/1974 Harigaya et al. ..... 420/504

FOREIGN PATENT DOCUMENTS 4633387 9/1971 Japan ..... 420/506

4829450 9/1973 Japan ..... 420/506

*Primary Examiner*—R. Dean

*Assistant Examiner*—Robert R. Koehler

*Attorney, Agent, or Firm*—Fleit, Jacobson, Cohn, Price, Holman & Stern

[57] ABSTRACT

Ag allow generally used for decorative purposes such as silverware and accessories, including In and Al as a substitute for conventionally used Pd provides the products with high discoloration resistance and elegant tint inherent to Ag. Additional content of Cu further improves mechanical properties of the products.

4 Claims, No Drawings

AG ALLOY OF HIGH DISCOLOURATION RESISTANCE

BACKGROUND OF THE INVENTION

The present invention relates to Ag alloys of high discoloration resistance, and more particularly relates to improvement in color maintenance of Ag alloys generally used for building parts, interior decorations, kitchen utensils and silverware.

Au-Ag-Pd type alloys are generally known as typical As alloys of high discoloration resistance. Japanese Patent Opening Sho. No, 53-43620 also discloses another Ag alloy of white color, high corrosion resistance and excellent for machining. The alloy is suited for use for watchcases and contains Ag, Pd, Sn and Zn. Optionally, Mg, Al, Ge, In and Ni are added individually or in combination. In either of the two conventional Ag alloys of high discoloration resistance, it is essential to contain 10 or more % by weight of Pd for sufficient xanthation resitance.

Despite the relatively improved discoloration resistance, such conventional Ag alloys are very exepensive due to high content of costly Pd. In addition, high content of Pd provides the products with relatively blck tint, thereby marring the inherently beautiful color of Ag.

BRIEF SUMMARY OF THE INVENTION

It is the primary object of the present invention to provide Ag alloy of low price and high discoloration resistance.

In accordance with the basic aspect of the present invention, Ag alloys comprise 0.2 to 9.0% by weight of In and 0.02 to 2.0% by weight of Al.

DESCRIPTION OF PREFERRED EMBODIMENTS

As stated above, Ag alloys in accordance with the present invention comprise 0.2 to 9.0% by weight of In and 0.02 to 2.0% by weight of Al. No improvement in xanthation resistance is expected when the content of In falls below 0.2% by weight, whereas the inherent beautiful color of Ag is degraded when the content of In exceeds 9.0% by weight. Any weight percent content of Al below 0.02 would enable improvement in discoloration resistance. Chlorination resistance of the product is much degraded when weight percent content of Al exceeds 2.0% by weight. As well known, addition of In raises discoloration resistance of Ag. However, sole addition of In more that 10% by weight adds yellow tint to the product, and such yellow tint is much furthered by xanthation. Addition of Al well oppresses yellow discoloration caused by addition of In and naturally reduces percent cconten of In, thereby raising xanthation resistance of the product. No improvement in xanthation resistance is expected by sole addition of Al.

In one preferred embodiment of the present invention, Ag alloys further comprise 0.3 to 3.0% by weight of Cu for improvement in mechanical properties, more specifically hardness of the product. No appreciable effect is observed when the content is below 0.3% by weight whereas any percent content above 3.0% by weight would degrade xanthation resistance of the product, admittedly increasing the hardness.

In another preferred embodiment of the present invention, Ag alloys further comprises Cd, Sn, Ga and Zn individually or in combination for improvement in xanthation resistance and suitability for casting.

With the above-proposed composition, elements forming the Ag alloys are believed to form an inert film on the surface of the product, which makes the product well resistant against xanthation and chlorination, thereby accordingly raising discoloration resistance.

EXAMPLES

Samples Nos. 1 to 34 having compositions shown in Table 1 were prepared. The surface of each Sample was polished for evaluation of the tint. Next, the Sample was immersed for 10 hours in a $Na_2S$ bath of 0.1% concentration and in NaCl bath of 5% concentration, respectively, for investigation of degree of discoloration. The results are shown in Table 2 in which X indicates high degree of discoloration, Δ indicates some degree of discoloration and O indicates substantially no discoloration. Samples Nos. 33 and 34 were prepared merely for comparison purposes.

TABLE 1

| Sample No. | Composition in % by weight | | | | | | | |
|---|---|---|---|---|---|---|---|---|
| | In | Al | Cu | Cd | Sn | Ga | Zn | Ag |
| 1 | 0.1 | 0.01 | | | | | | Bal |
| 2 | 0.2 | 0.02 | | | | | | Bal |
| 3 | 2.0 | 2.0 | | | | | | Bal |
| 4 | 4.0 | 2.0 | | | | | | Bal |
| 5 | 6.0 | 1.5 | | | | | | Bal |
| 6 | 9.0 | 1.5 | | | | | | Bal |
| 7 | 9.0 | 0.02 | | | | | | Bal |
| 8 | 10.0 | 4.0 | | | | | | Bal |
| 9 | 6.0 | 2.0 | 0.23 | | | | | Bal |
| 10 | 6.0 | 1.0 | 1.5 | | | | | Bal |
| 11 | 6.0 | 1.5 | 3.0 | | | | | Bal |
| 12 | 7.0 | 1.5 | 4.0 | | | | | Bal |
| 13 | 8.0 | 1.3 | 1.8 | | 1.0 | | 1.5 | Bal |
| 14 | 7.0 | 1.0 | 1.15 | | | 1.0 | 1.7 | Bal |
| 15 | 8.0 | 1.0 | 2.0 | 1.6 | | 3.0 | | Bal |
| 16 | 8.0 | 1.0 | 3.8 | 0.75 | 0.85 | 0.7 | | Bal |
| 17 | 5.0 | 1.0 | 1.0 | 0.2 | 0.7 | 0.5 | 1.0 | Bal |
| 18 | 6.0 | 1.0 | | 3.0 | | | | Bal |
| 19 | 5.0 | 1.0 | | | 3.5 | | | Bal |
| 20 | 6.0 | 0.03 | | | | | 0.01 | Bal |
| 21 | 6.0 | 1.0 | | | | | 4.0 | Bal |
| 22 | 4.0 | 1.0 | | | | | 7.0 | Bal |
| 23 | 6.0 | 0.03 | | 0.01 | | 0.01 | | Bal |
| 24 | 7.0 | 0.8 | | | 1.5 | | 2.0 | Bal |
| 25 | 4.0 | 1.0 | | | | 4.5 | 3.0 | Bal |
| 26 | 4.0 | 0.3 | | 0.3 | 0.5 | 0.5 | | Bal |
| 27 | 10.0 | 0.3 | | 1.0 | 1.9 | 1.45 | 2.1 | Bal |
| 28 | 4.5 | 0.01 | | | | 0.01 | 0.01 | Bal |
| 29 | 3.5 | 0.8 | | 0.7 | 0.5 | | 0.5 | Bal |
| 30 | 6.5 | 4.0 | | | 0.4 | 0.8 | | Bal |
| 31 | 3.0 | 0.8 | | 0.5 | 0.2 | 1.0 | 0.9 | Bal |
| 32 | 3.0 | 1.0 | | 1.8 | 2.5 | 1.3 | 2.0 | Bal |
| 33 | 5Au—25Pd—Ag alloy | | | | | | | |
| 34 | 100% Ag | | | | | | | |

Bal: in balance

TABLE 2

| Sample No. | Degree of discoloration | | Tint |
|---|---|---|---|
| | 0.1% $Na_2S$ | 5% NaCl | |
| 1 | Δ | O | Silver |
| 2 | O | O | Silver |
| 3 | O | O | Silver |
| 4 | O | O | Silver |
| 5 | O | O | Silver |
| 6 | O | O | Silver |
| 7 | O | O | Silver yellow |
| 8 | Δ | Δ | Silver yellow |
| 9 | O | O | Silver |
| 10 | O | O | Silver |
| 11 | O | O | Silver |
| 12 | Δ | O | Silver |
| 13 | O | O | Silver |

TABLE 2-continued

| Sample No. | Degree of discoloration 0.1% $Na_2S$ | 5% NaCl | Tint |
|---|---|---|---|
| 14 | O | O | Silver |
| 15 | O | O | Silver |
| 16 | Δ | O | Silver |
| 17 | O | O | Silver |
| 18 | O | O | Silver |
| 19 | O | O | Silver |
| 20 | O | O | Silver |
| 21 | O | O | Silver |
| 22 | O | Δ | Silver |
| 23 | O | O | Silver |
| 24 | O | O | Silver |
| 25 | O | Δ | Silver |
| 26 | O | O | Silver |
| 27 | O | O | Silver |
| 28 | Δ | O | Silver |
| 29 | O | O | Silver |
| 30 | O | Δ | Silver |
| 31 | O | O | Silver |
| 32 | Δ | Δ | Silver |
| 33 | O | O | Metallic black |
| 34 | X | O | Silver |

It is clear form Table 2 that content of In below 0.2% by weight assures no good discoloration resistance against $Na_2S$. When the content of In exceeds 9% by weight the product assumes yellow tint quite different form the inherently beautiful color of Ag. Percent content of Al above 2.0% by weight assures no good discoloration resistance against NaCl. When content of Cu exceeds 3.0% by weight, the product exhibits no good discoloration resistance against $Na_2S$. Contents of Cd, Sn, Ga and/or Zn beyond 6.5% by weight rather degrades discoloration resistance and makes the product brittle due to formation of inter metallic compounds.

Samples Nos. 35 to 43 as shown in Table 3 were prepared for measurement of mechanical properties and the results of are shown in Table 4. Here sample 41 is the same in composition as Sample 13, Sample 42 is the same as Sample 14 and Sample 43 is the same as Sample 15 in Table 1, respectively.

TABLE 3

| Sample No. | Composition in % by weight In | Al | Cu | Cd | Sn | Ga | Zn | Ag |
|---|---|---|---|---|---|---|---|---|
| 35 | 4.0 | 2.0 | | | | | | Bal |
| 36 | 4.0 | 2.0 | 0.3 | | | | | Bal |
| 37 | 6.0 | 2.0 | 0.5 | | | | | Bal |
| 38 | 8.0 | 1.0 | 3.0 | | | | | Bal |
| 39 | 7.0 | 1.5 | 2.0 | | | | | Bal |
| 40 | 7.0 | 1.5 | 3.0 | | | | | Bal |
| 41 | 8.0 | 1.3 | 1.8 | | 1.0 | | 1.5 | Bal |
| 42 | 7.0 | 1.0 | 1.15 | | | 1.0 | 1.7 | Bal |
| 43 | 8.0 | 1.0 | 2.0 | 1.6 | | 3.0 | | Bal |

TABLE 4

| Sample No. | Mechanical properties Elongation in % | Hardness |
|---|---|---|
| 35 | 43 | 75 |
| 36 | 42 | 80 |
| 37 | 38 | 93 |
| 38 | 35 | 127 |
| 39 | 36 | 125 |
| 40 | 31 | 140 |
| 41 | 29 | 145 |
| 42 | 35 | 123 |
| 43 | 30 | 138 |

It is clear form the results shown in Table 4 that addition of Cu causes moderate increase in hardness. Although ductility of the product is somewhat degraded, the product is still acceptable for working. Any percent content of Cu over 3.0% by weight, however, would cause unacceptable lowering in ductility and, in addition, mar discoloration resistance.

Sample 3 was immersed in a $na_2S$ bath of 0.1 concentration for 10 hours after heat treatment at various temperatures for various periods and degrees of discoloration were measured. The heating periods are shown in Table 5 with the results of measurement. In Table 5, O indicates substantially no discoloration, Δ indicates discoloration and X indicates solution of the sample.

As is clear from the data in Table 5, heating at a temperature below 220° C. would cause no appreciable improvement in discoloration resistance whereas the sample melts beyond 900° C. Further, it was confirmed that no appreciable effect can be observed when the period is shorter than 1 min. Measurement was carried out using the above-described Samples and the same result was obtained in the compositions as set out in the appended claims.

TABLE 5

| Temperature in °C. | Period in min. 0.5 | 1.0 | 30 | 60 | 120 | 240 | 480 | 960 |
|---|---|---|---|---|---|---|---|---|
| 150 | Δ | Δ | Δ | Δ | Δ | Δ | Δ | Δ |
| 200 | Δ | Δ | Δ | Δ | Δ | Δ | Δ | Δ |
| 220 | Δ | O | O | O | O | O | O | O |
| 300 | Δ | O | O | O | O | O | O | O |
| 350 | Δ | O | O | O | O | O | O | O |
| 400 | Δ | O | O | O | O | O | O | |
| 450 | Δ | O | O | O | O | O | | |
| 500 | Δ | O | O | O | O | | | |
| 550 | Δ | O | O | O | | | | |
| 600 | Δ | O | O | O | | | | |
| 650 | Δ | O | O | O | | | | |
| 700 | Δ | O | O | | | | | |
| 750 | Δ | O | O | | | | | |
| 800 | Δ | O | O | | | | | |
| 850 | Δ | O | O | | | | | |
| 900 | Δ | O | O | | | | | |
| 950 | Δ | X | X | | | | | |

Further Samples 4, 16, 23, 24 and 31 were immersed in a $(Na_4)_2SX$) for 30 min. Discoloration into brown tint started at a period of 1 min. from beginning of the immersion and dark blue tint was reached at the period of 30 min. During the test, the samples exhibited elegant color suited for decorative purposes. After the immersion, the samples were left in the atmospheric environment for 6 months, but no substantial change in color was observed while maintaining the initial elegant tint.

We claim:

1. Ag alloy of high discolouration resistance comprising:

0.2 to 9.0% by weight of In;

0.02 to 2.0% by weight of Al; and the balance Ag.

2. Ag alloy as claimed in claim 1 and further comprising:

0.3 to 3.0% by weight of Cu.

3. Ag alloy as claimed in claim 1 and further comprising:

0.01 to 6.5% by weight of Cd; and 0.01 to 1.5% by weight of at least one member selected from the group consisting of Sn, Ga and Zn.

4. Ag alloy as claimed in claim 2 and further comprising:

0.01 to 6.5% by weight of Cd; and 0.01 to 1.5% by weight of at least one member selected from the group consisting of Sn, Ga and Zn.

* * * * *